US006550880B2

(12) United States Patent
Reuter

(10) Patent No.: US 6,550,880 B2
(45) Date of Patent: Apr. 22, 2003

(54) MODULAR STORAGE CABINET

(75) Inventor: Robert E. Reuter, East Setauket, NY (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 09/881,291

(22) Filed: Jun. 13, 2001

(65) Prior Publication Data

US 2002/0190614 A1 Dec. 19, 2002

(51) Int. Cl.[7] ..... A47B 47/00
(52) U.S. Cl. ..... 312/265.3; 312/257.1
(58) Field of Search ..... 312/257.1, 263, 312/265.1, 265.2, 265.3, 265.4

(56) References Cited

U.S. PATENT DOCUMENTS

| | | | | | |
|---|---|---|---|---|---|
| 2,158,291 | A | * | 5/1939 | Lank | 191/64 |
| 3,836,217 | A | | 9/1974 | Shiina | |
| 4,087,786 | A | | 5/1978 | Furneax | |
| 4,621,877 | A | | 11/1986 | Boudreau et al. | |
| 4,621,879 | A | * | 11/1986 | Schneider | 312/140 |
| 4,786,122 | A | | 11/1988 | Nichoalds | |
| 4,846,078 | A | | 7/1989 | Janson | |
| 5,039,177 | A | | 8/1991 | Newell et al. | |
| 5,123,720 | A | | 6/1992 | Blomster et al. | |
| D337,455 | S | | 7/1993 | Magnusson et al. | |
| 5,466,058 | A | | 11/1995 | Chan | |
| 5,590,939 | A | | 1/1997 | Piontek | |
| 5,915,803 | A | | 6/1999 | Daugherty et al. | |
| 5,975,660 | A | * | 11/1999 | Tisbo et al. | 312/108 |
| D423,814 | S | | 5/2000 | Belka et al. | |
| 6,185,878 | B1 | | 2/2001 | Bullard, III et al. | |

* cited by examiner

*Primary Examiner*—Janet M. Wilkens
(74) *Attorney, Agent, or Firm*—Buchanan Ingersoll, P.C.

(57) ABSTRACT

A modular storage cabinet which can be shipped in a knocked-down condition and assembled on site with a minimal number of mechanical fasteners. Arcuate end connectors are provided for the side panels, which end connectors engage a tube at the corner connections. A sleeve slides over the arcuate end connectors, securely locking the side panels to the tube without the need for screws or any other fasteners. Top and bottom panels are attached at the corner connection assemblies. The cabinet includes a front panel which pivotally receives.one or more doors, or the doors can be directly connected to the top and bottom panels. The side walls in the preferred embodiment are manufactured by a plastic injection molding process. The interior of the side walls may include screw bosses integrally formed therein for attachment of drawer slides, shelving or other accessories. The corner connection assembly can be used for any type of corner connections, such as for modular office panel systems.

18 Claims, 8 Drawing Sheets

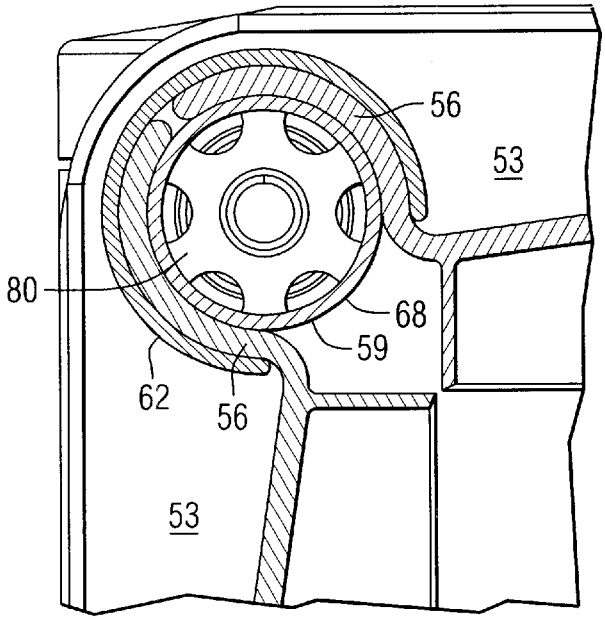
FIG. 4A
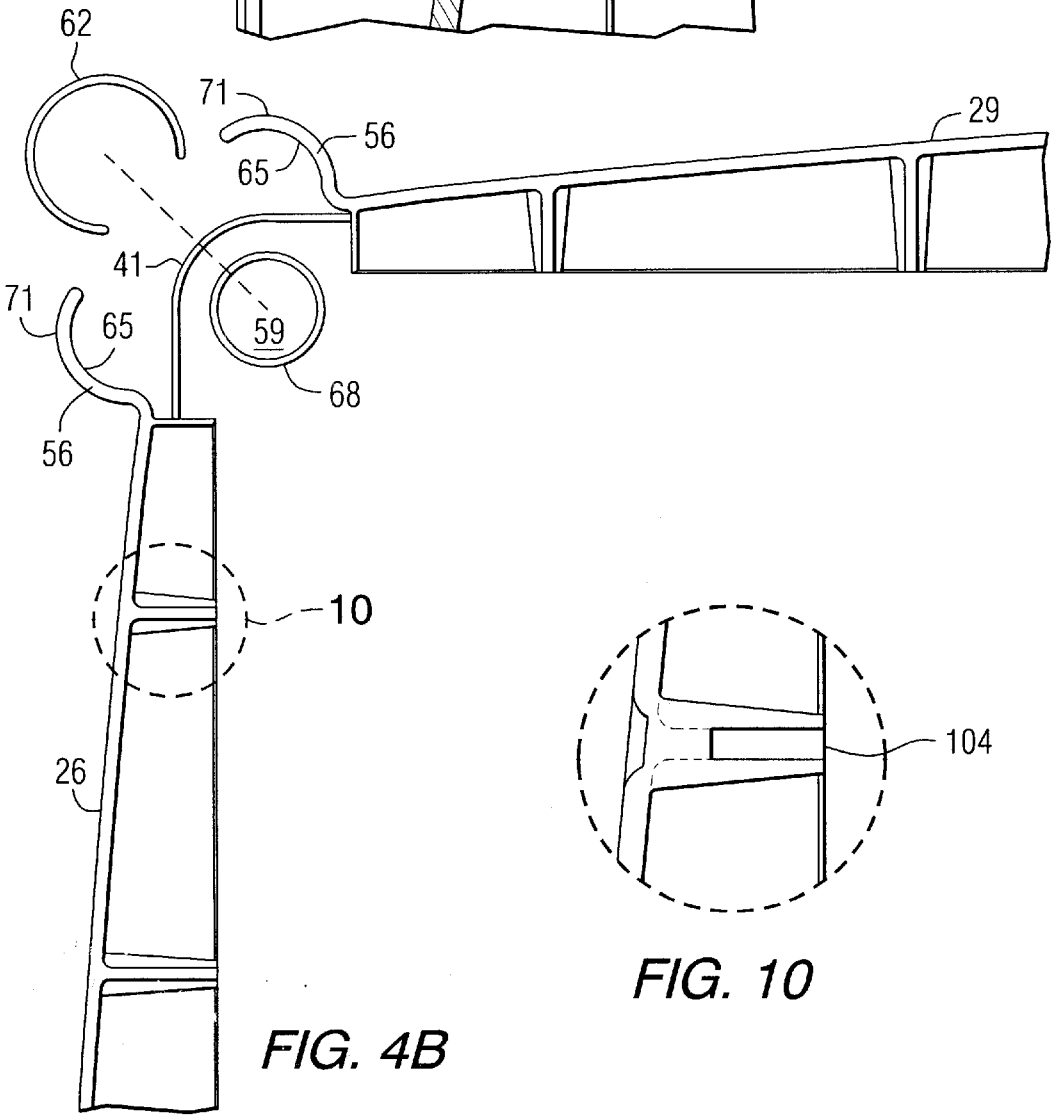
FIG. 4B
FIG. 10

MODULAR STORAGE CABINET

BACKGROUND OF THE INVENTION

1. Field of the Invention

The present invention relates to modular office systems, and more particularly to a modular storage cabinet which can be shipped in a knockdown condition and substantially constructed without the need for mechanical fasteners and the like.

2. Description of the Prior Art

Modular office components which can be manufactured and shipped in a knock-down condition for later assembly at the users site are well known in the art. With such systems, it is generally necessary to use mechanical fasteners, such as bolts or screws or the like, in order to assemble the office component at the site. This requires the packaging and shipping of the fasteners and special tooling with the component, or the user or assembler must separately obtain such tooling in order to construct the office component. For those components which can "snap" together, such as a storage cabinet for children's toys or outdoor furniture and the like, frictional snap-fit connections are provided for the individual pieces. However these typically provide only a storage area and cannot accommodate shelving in the interior because of the construction of the storage cabinet. This is generally due to the fact that the snap-fit connections, while sufficient to hold the individual pieces together, are not sturdy enough to support interior structures or accessories.

In order to provide a more rigid structure, it is often necessary to incorporate metal structural elements into the component pieces. These are either separate components or, more typically, incorporated into the non-metal components which make up the panels for the modular office component. Therefore, this complicates the manufacture of the individual pieces which make up the assembled component as well as requiring post-manufacture activity such as painting to provide a neat and trim appearance for the assembled cabinet.

What is needed is a knock-down, portable furniture component which can be easily constructed at the users site without the need for special tooling. It would also be desirable if such a component could be constructed without requiring additional fasteners. Preferably the components can be made of molded material, such as plastic, which can be easily manufactured without requiring post-manufacture finishing.

It is therefore an object of the present invention to provide an easily reconfigurable furniture component which can be readily assembled at a users site without the need for special tooling.

It is a further object to the present invention to provide a modular storage cabinet which can accommodate doors, drawers, and shelving or other accessories, for a compartmentalized interior.

It is still a further object of the present invention to provide a modular storage cabinet which requires minimal metal fasteners for assembly.

It is yet a still further object of the present invention to provide a modular storage cabinet having door mounted and/or removable storage bins for filing and electronic media storage.

SUMMARY OF THE INVENTION

In accordance with the present invention, a modular furniture assembly comprises a plurality of side walls, each of which side wall includes a body portion and two opposed arcuate connector portions. Means are provided for connecting adjacent side walls at an angle therebetween to form a generally closed component. A top panel is connected to a top portion of the connecting means, and a bottom panel is connected to a bottom portion of the connecting means. One of the side wall panels is adapted to receive a door and/or drawer. Preferably, an injection molding construction of the side wall panel facilitates attachment of shelving to the interior of the cabinet.

In a method of assembling a modular furniture component, the method comprises the steps of providing a plurality of wall panels, each of said wall panels having a body portion and arcuate connector portions on either end thereof, said arcuate connector portions having an outer surface, providing a plurality of cylindrical members having an outer perimeter, and providing a plurality of C-shaped sleeves having an inner surface. A top panel and a bottom panel are provided, the cylindrical members being connected to the bottom panel at a bottom end of the cylindrical members. Wall panels are placed adjacent the cylindrical members such that arcuate connector portions are disposed about the outer perimeter of the cylindrical member at a plurality of comers. A sleeve is placed adjacent each of the corners such that the inner surface of the sleeve is disposed about the outer surface of the arcuate connector portions. The top panel is connected to the cylindrical member at a top end thereof.

BRIEF DESCRIPTION OF THE DRAWINGS

Various other objects, features and advantages of the invention will become more apparent by reading the following detailed description in conjunction with the drawings, which are shown by way ample only, wherein:

FIG. 4, consisting of FIGS. 4A and 4B, are detailed views of a corner connection assembly according to the present invention;

FIG. 10 is a detailed view of a screw boss incorporated into a wall panel;

DESCRIPTION OF THE PREFERRED EMBODIMENTS

Figure 1:
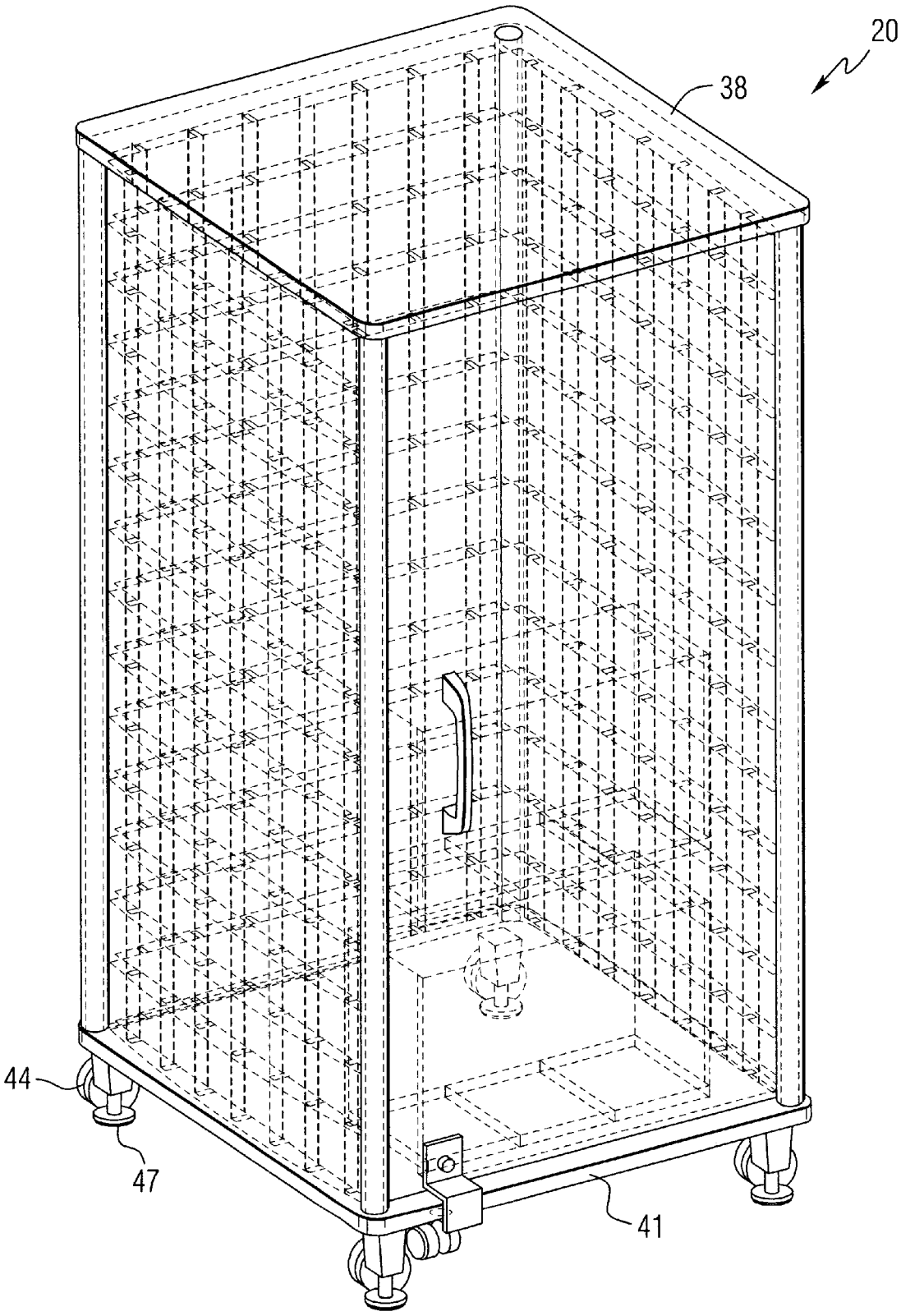
FIG. 1 is a perspective view of a modular storage cabinet constructed according to the present invention.
Figure 2:
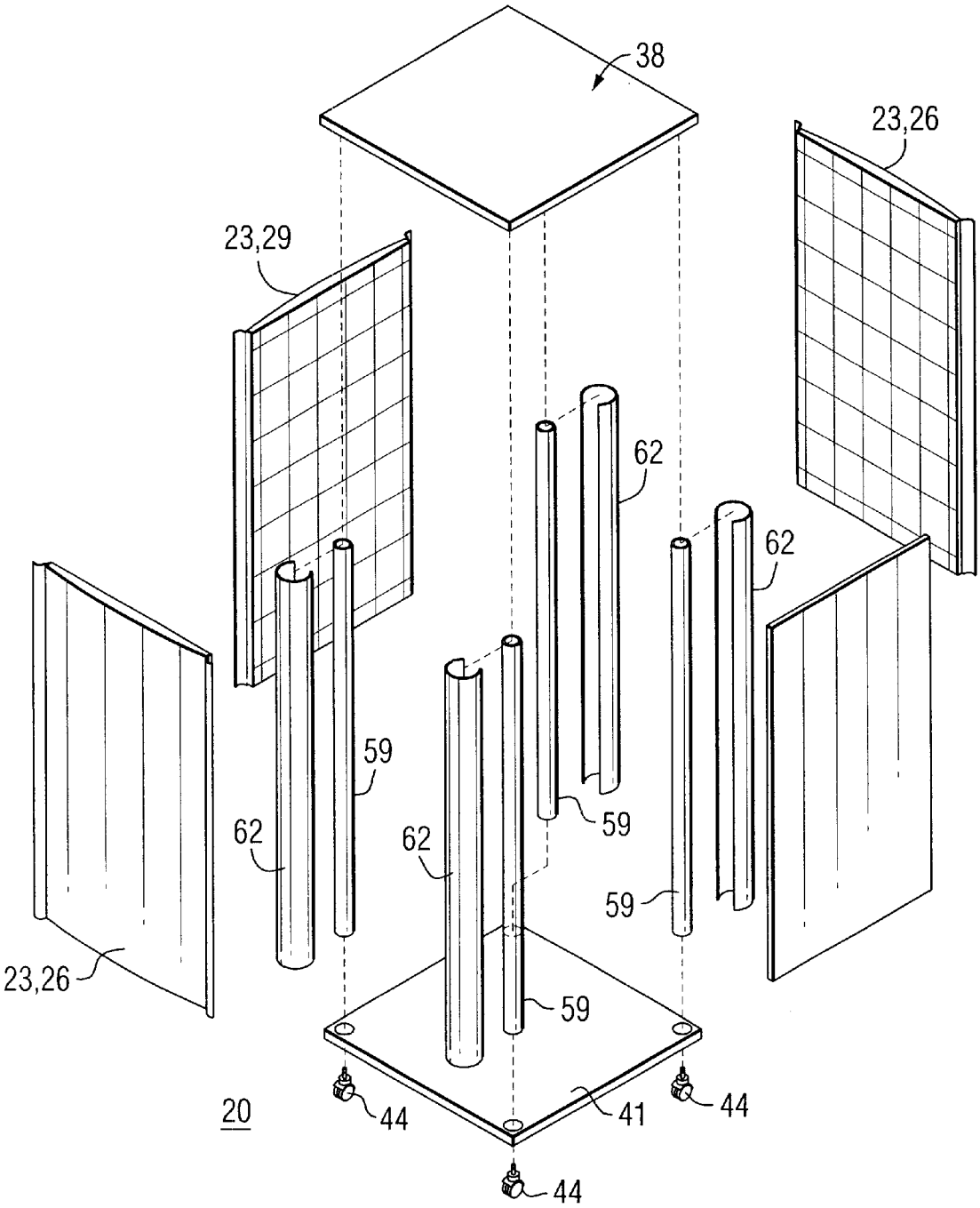
FIG. 2 is an exploded view of the storage cabinet of FIG. 1.

Referring now to the drawings in detail, there is shown in FIGS. 1 and 2 a modular storage cabinet 20 constructed according to the present invention. In its assembled condition, the storage cabinet comprises three wall panels 23, two side panels 26 and a back panel 29, and a front panel which can accommodate door(s) 32 and/or drawers 35, as will be described more fully hereinafter. A top 38 and bottom 41 panel are also provided, as is more fully described hereinafter. As shown in FIG. 1, the storage cabinet 20 can accommodate either casters 44, for ease of transportability of the assembled component, or fixed feet 47 for supporting the cabinet upon the floor. A unique corner connector system is provided for the present invention, which reduces the need for mechanical fasteners and special tooling to assemble the storage cabinet. Although the present invention is described herein with respect to a modular storage cabinet, it will be appreciated by those skilled in the art that the corner connector assembly, to be described more fully herein, can be used for the construction of any type of modular office component, including, but not limited to, panel wall systems.

Figure 3:
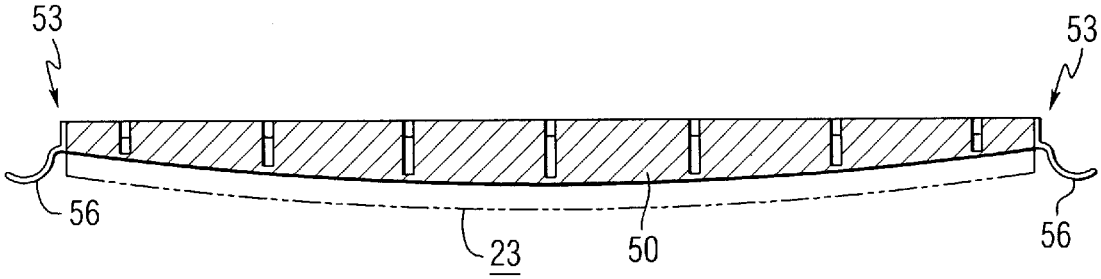
FIG. 3 is a bottom view of a wall panel shown in FIG. 2.
Figure 6B:
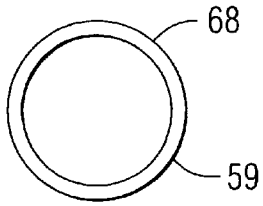
FIG. 6, consisting of FIGS. 6A and 6B, are detailed views of a corner connector tube for the present invention.
Figure 6A:
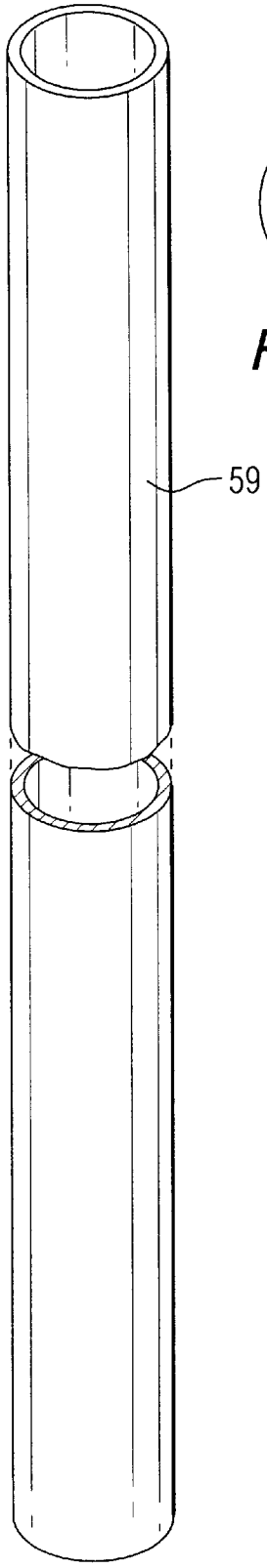
Figure 7B:
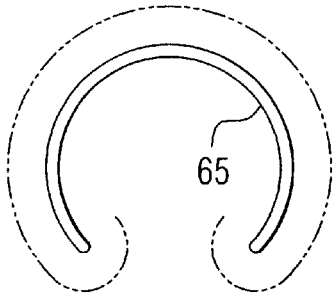
FIG. 7, consisting of FIGS. 7A and 7B, are detailed views of a corner connector sleeve for the present invention.
Figure 7A:
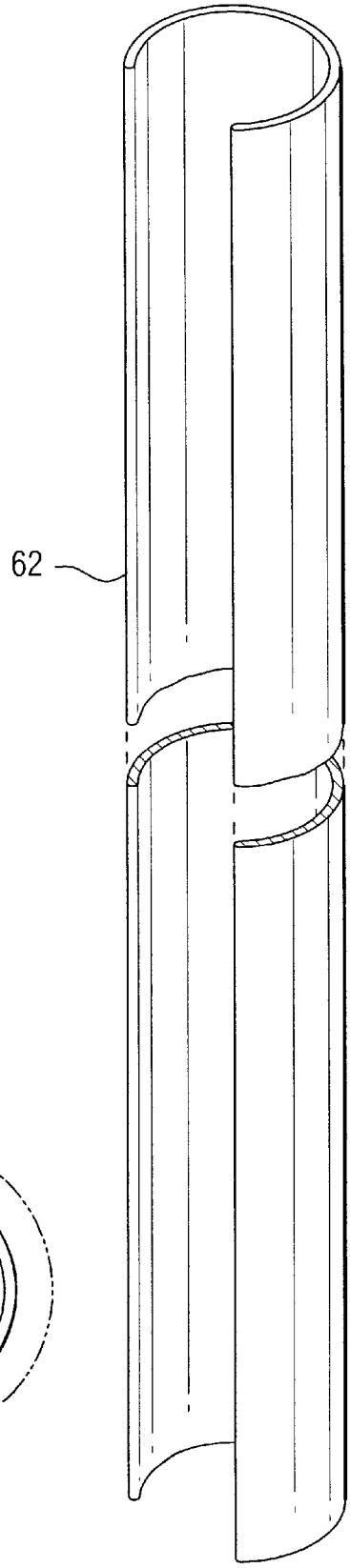

The wall panels 23, shown in detail in FIGS. 2 and 3, are preferably manufactured of the identical type assembly, with a body portion 50 having opposed ends 53 thereof which have a semicircular or arcuate connector portion 56. The body portion 50 of the panel can be manufactured having any decorative appearance. The corner connection assembly preferably uses a tube 59 (FIG. 6) and a generally C-shaped locking sleeve 62 (FIG. 7) arrangement for capturing the arcuate connector portions 56, and thus the panels 23,.in a secure manner. In a preferred embodiment the tube 59 is made of steel and comprises a hollow cylinder member. Since this component is essentially hidden within the completed modular component assembly, it does not have to be finished after manufacture.

As shown more particularly in FIGS. 4A and 4B, at the junction of two panels 23, such as one side panel 26 and a back panel 29, the corner connector sleeve 62 is positioned such that an inner surface 65 of the connector portions 56 of two adjacent panels are disposed about the outer perimeter 68 of the tube 59, generally at about a 90° angle. The sleeve 62 is then positioned on the outer surface 71 of the arcuate connector portions 56 and preferably slides over them into place, securely locking the connector portions 56 around the tube 59. FIG. 4A shows the assembly in the connected configuration, while FIG. 4B is an exploded view of the corner connection components. While the present invention has been described with respect to a generally rectangular or square cabinet, it will be appreciated by those skilled in the art that different configurations are attainable with the present invention. For example, the arcuate connector portions may be molded to extend from the body portion at an angle of 120° for a triangular configuration, or at about 72° for a pentagonal configuration.

Figure 5:
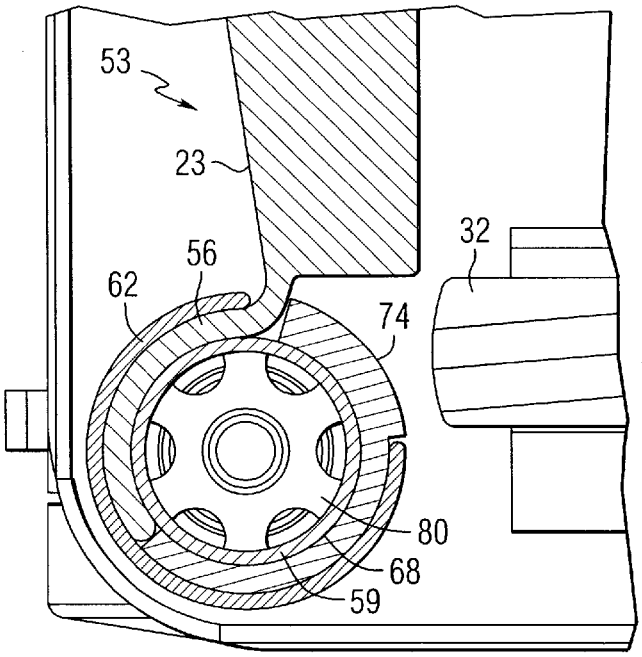
FIG. 5 is a detailed view of a door opening connection for the storage cabinet shown in FIG. 1.
Figure 8A:
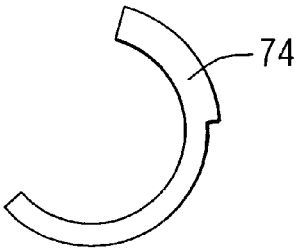
FIG. 8, consisting of FIGS. 8A and 8B, are views of a door opening lock insert shown in FIG. 5.
Figure 8B:
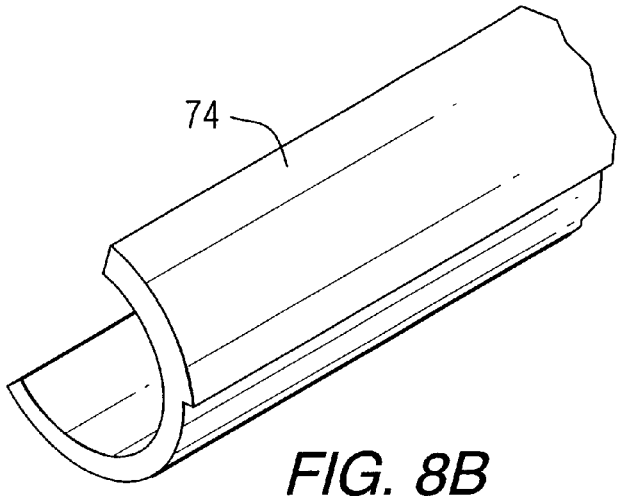
Figure 11:
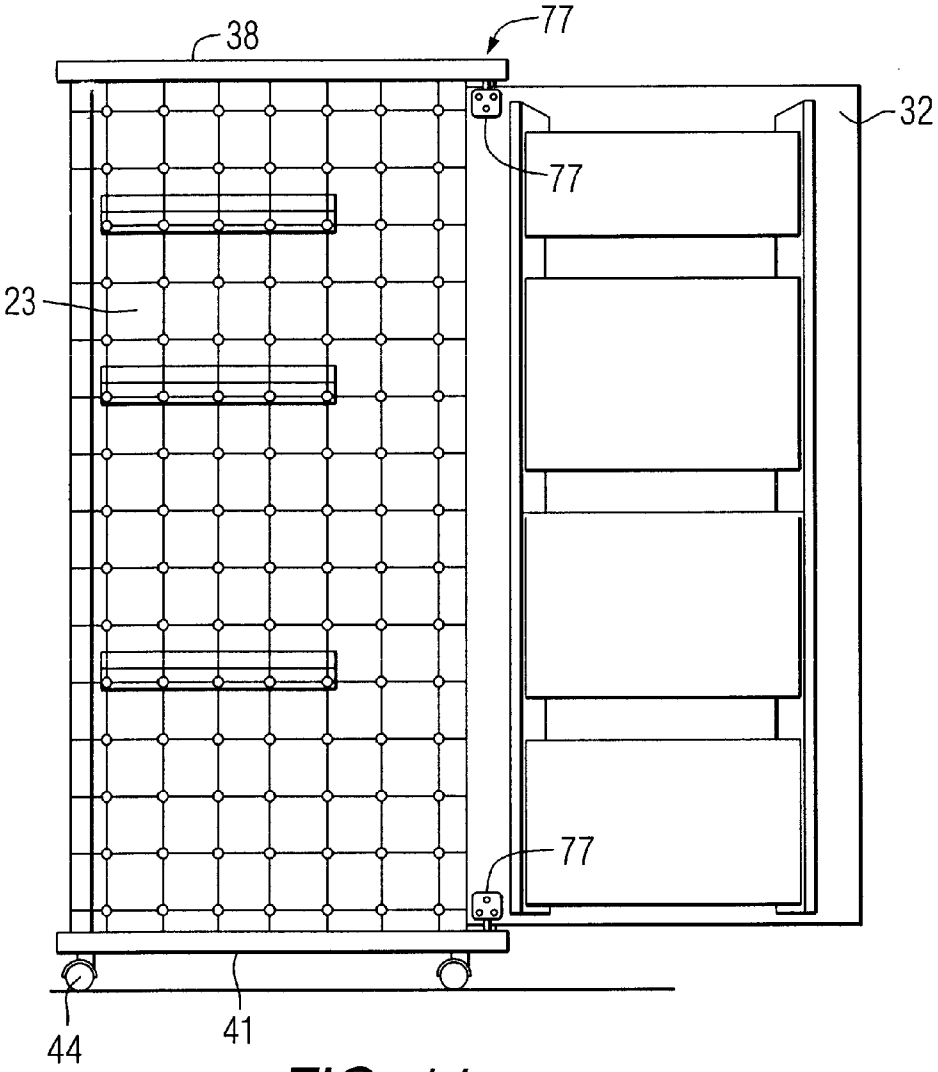
FIG. 11 is a front view of one embodiment of the present invention showing the door in an open position.

As shown in FIG. 5, a somewhat different connector method is used for a side panel end which is not connected to another wall panel 23, but is adjacent an opening for a door 32 or the like. Since there is not a wall panel which is connected to another wall panel, a filler element 74 is used (FIG. 8). It is constructed in the same manner as the arcuate connector portion 56, in that the connector portion of the wall panel 23 and the filler 74 are disposed about the outer perimeter 68 of the tube 59 and locked into position by the sleeve 62. In this manner the filler 74 also provides a decorative appearance such as when the door is in a open position. Preferably, the door 32 is pivotally connected 77 at one end to the top 38 and bottom 41 panels (FIG. 11). In an alternate embodiment, a window frame-shaped wall panel having opposed arcuate connector portions can be used. The door can then be pivotally attached to the top and bottom portion of the door frame panel.

To assist in securing the wall panels rigidly together, top and bottom panels are provided to complete the storage cabinet. Either feet or castors can be used with the bottom panel according to the desires of the user. The storage cabinet of the present invention can be easily constructed using a minimal number of metal fasteners and specialized tooling. Thus the cabinet can be shipped in a knocked-down condition which provides a more compact size for inventory and shipping of the modular furniture component. Moreover, upon removal of the individual pieces of the modular storage component, a user does not have to be overly concerned with a multitude of small pieces such as screws, nuts and bolts which could easily become lost upon opening the box within which the pieces are shipped. Additionally, it is much easier for one person to construct the pieces into the finished storage cabinet, since it is not required that one person hold the pieces together while another person must assemble the screws and/or bolts within the cabinet.

By use of the corner connector assembly of the present invention, a substantially continuous connection is provided between and among the individual panel assemblies to provide a neat and clean appearance for the finished component. The individual components can be easily manufactured. Preferably this is done by molding of every side wall component which comprises the storage cabinet from a plastic material. Preferably each of the wall panels is manufactured identically; however, different panels can be manufactured either to provide a variety of outward appearances for the storage cabinet or for a user to construct a component from any type of panel. All that is required is that the end connector portions 56 be of a similar construction, which match the dimensions of the tube 59 and sleeve 62.

Figure 9:
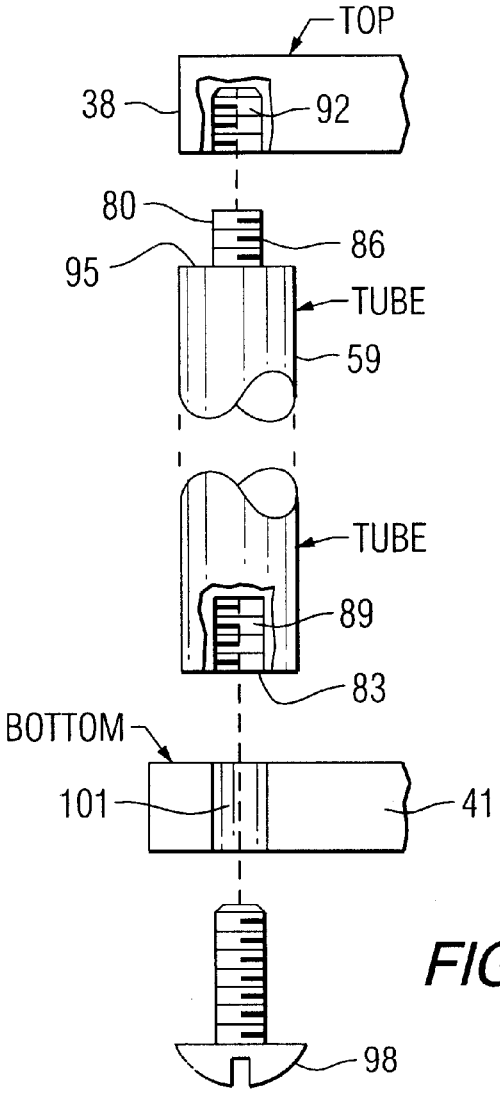
FIG. 9 is an exploded view of the top and bottom panel connection with the connector tube of the corner connector assembly.

In order to attach the top 38 and bottom 41 panels to the corner connector assemblies, top 80 and bottom 83 inserts are provided, as shown in FIG. 9. In the preferred embodiment shown in FIG. 9, the top cap 80 comprises a male-type 86 threaded insert while the bottom cap 83 includes a female-type 89 threaded insert. It will be appreciated by those skilled in the art that the threaded orientations for the top and bottom caps could be switched, or identical inserts could be used for both the top and bottom caps. Four top and bottom caps are provided, i.e., one for each corner connection assembly, the actual number depending upon the shape and number of sides for the storage cabinet. Preferably, the top 80 and bottom 83 caps are made of metal, but could be made of molded plastic. Regardless of the material from which the caps are manufactured, they are preferably snap-fit into the tubes.

In the preferred embodiment, the top and bottom panels, as well as the door, are manufactured from medium density fibreboard (MDF) to minimize manufacturing costs, but could also be made of molded plastic. A veneer can be provided for the MDF, or the components could be painted to provide a neat, trim appearance for the assembled furniture system.

Figure 12:
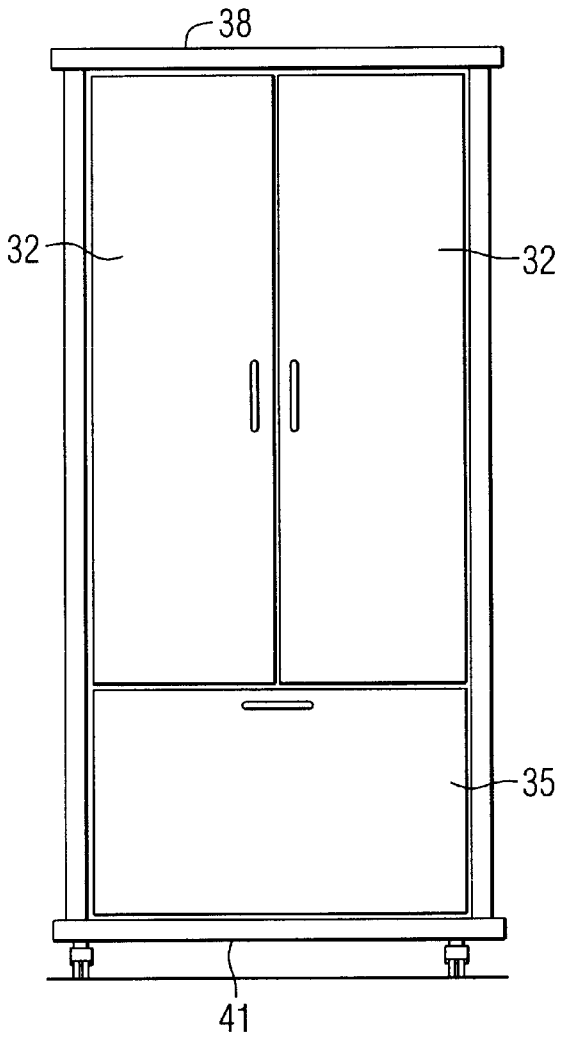
FIG. 12 is a front view of an alternate embodiment of the present invention having two doors and a drawer.

In order to assemble the modular storage cabinet of the present invention, the following steps are preferably performed:

If male-threaded top caps 80 are provided, one of these is threaded into a complementary opening 92 in each comer of the top panel 38. The tubes 59 are then snap-fitted over the opposite end 95 of each of the top caps 80. Next, the arcuate end connector portions 56 of a side panel 26 and the back panel 29 are positioned about one of the tubes 59 and a sleeve 62 positioned thereon to securely lock the side and back panels together without the need for screws or other fasteners. This positions the opposite end connectors of each of the side and back panels adjacent two other tubes. Next, the other side panel 26 is positioned such that one end connector portion is adjacent the opposite end connector portion of the back panel 29 and its sleeve 62 is slid into place. On the two remaining tubes, filler pieces 74 are positioned adjacent the tubes and the as-yet unconnected end connector portion of the side panel and sleeves are attached to lock these three wall panels 23 into place with respect to the top panel 38. The female-threaded bottom caps 83 are snapped into the bottom of each of the tubes 59 and the bottom panel 41 is positioned thereon. Screws or bolts 98 are then positioned adjacent holes 101 in the corners of the bottom panel and threaded or secured into the bottom caps 83 to secure the bottom panel. If desired, fixed feet 47 or casters 44 (FIG. 1) can be threaded into the bottom caps 83. In a most preferred embodiment, the feet or casters are fastened independently to the bottom panel. The assembly is then positioned right side up for attachment of the door(s) and/or drawer(s) 35. Pivoting assemblies 77 are attached to the top and bottom panels and the door(s) in a manner well known in the art. In the event that one or more drawers are provided (FIG. 12), drawer slides (not shown) can be attached to the side panels by utilizing the screw bosses 104 (FIG. 10) incorporated into a surface of the wall panels 23 during manufacture, and the drawer attached thereto according to conventional methods. Additionally, shelving or other accessories (not shown) can be easily attached to the interior surface of the wall panels utilizing the screw bosses 104.

Figure 13:
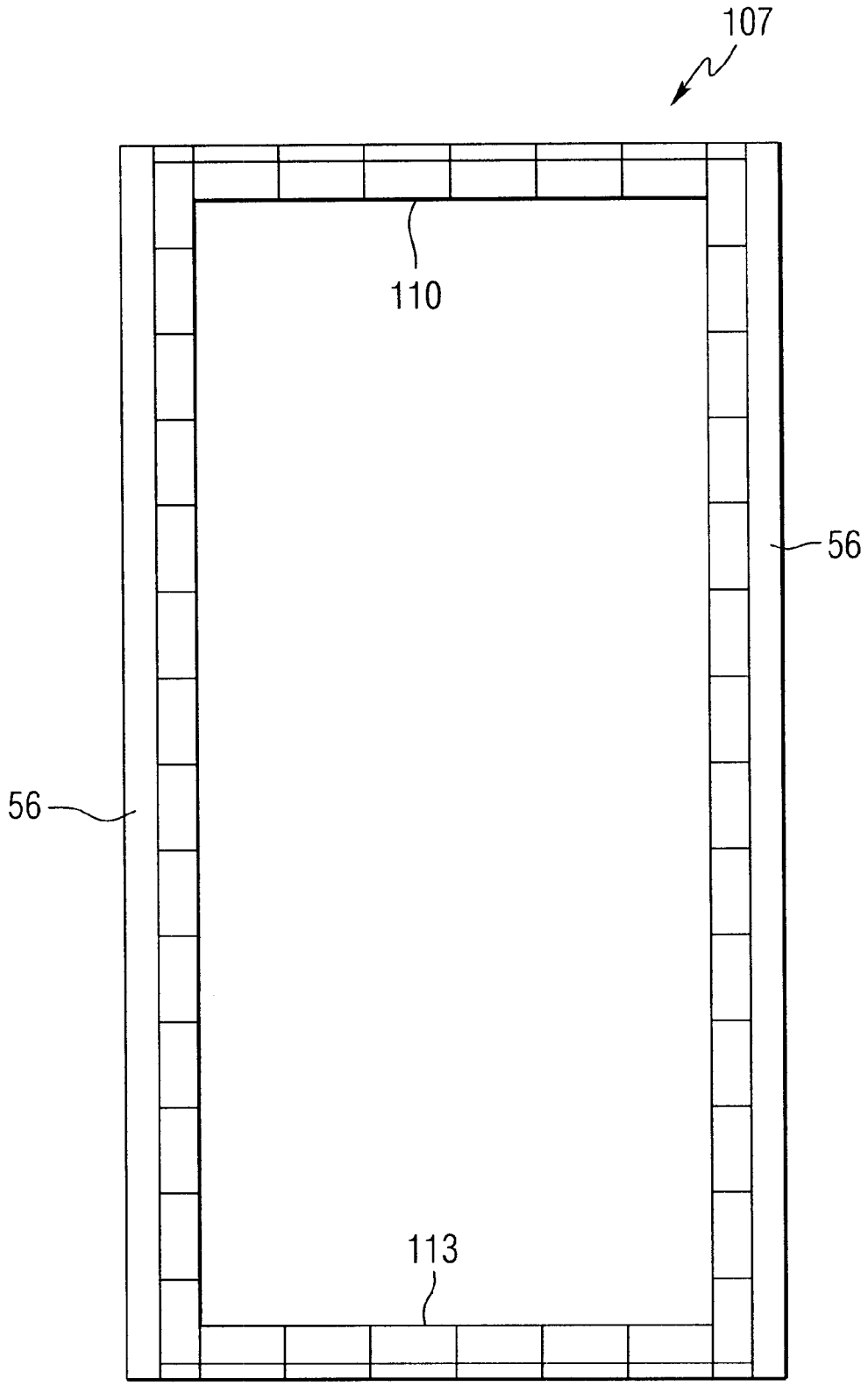
FIG. 13 is an alternate embodiment of a front panel for the modular storage cabinet of the present invention.

In an alternative embodiment shown in FIG. 13, a front wall panel 107 comprises a window frame like unit in which the arcuate end connector portions 56 are secured to the tubes 59 between the side walls 26 in the same manner as the back panel 29 and on a side opposite thereto. In this embodiment, the door(s) is pivotally mounted to the top 110 and bottom rails 113 of the front wall panel 107.

Since each of the components can be easily manufactured by a plastic injection molding process, the components can be manufactured in any color, as well as being clear or translucent. Thus, post-manufacture finishing of the components is not required. Moreover should it be desired to provide any type of mechanical fastener within the interior or exterior of the modular component, such as for attaching accessories to either the interior or exterior of the finished component, screw bosses or other attachment means can be incorporated into the wall panels of the storage cabinet as it is being manufactured (FIG. 10). The ability and methodology for incorporating such elements into injection molded components is well know to those skilled in the molding art. Thus screws and the like can be threaded into the panels, for example, and do not require any type of lock washer or the like to otherwise secure the screw to the cabinet.

Although it is the goal of the present invention to provide a knockdown cabinet which can be easily manufactured in the field, other concerns are met with the present invention. For example, at the end of the useful life of the component, as with all office furniture components, it becomes necessary to dispose of the individual pieces. Because the components of the unit can be completely manufactured from a plastic molding process, the individual products can be later recycled rather than dumped into a land fill, for example. Since it is not necessary to incorporate any metal components into the plastic parts for a sturdy construction, the pieces can be easily recycled at a plastics recycling center thus providing an additional environmental benefit to the modular storage cabinet of the present invention. Additionally, should it be desired by the user to disassemble the unit for reassembly elsewhere, the pieces can be easily taken apart, transported, and reassembled at another location without special tooling.

While specific embodiments of the invention have been described in detailed, it would be appreciated by those skilled in the art that various modifications and alternations would be developed in light of the overall teachings of the disclosure. For example, the tube can be a solid rod rather than a hollow cylindrical member. Accordingly, the particular arrangements disclosed are meant to be illustrative only and not limiting as to the scope of the invention, which is to be given the full breath of the appended claims and any and all equivalents thereof.

I claim:

1. A modular furniture assembly comprising:

a plurality of wall panels, each of said wall panels having a body portion and two opposed arcuate connector portions;

a plurality of cylindrical members for connecting adjacent wall panels such that an inner surface of adjacent arcuate connector portions are disposed about an outer perimeter of said cylindrical members, and a sleeve disposed about an outer surface of said adjacent arcuate connector portions;

a top panel connected to a top portion of said connecting means; and a bottom panel connected to a bottom portion of said connecting means.

2. The modular furniture assembly according to claim 1, wherein cylindrical members are hollow tubes.

3. The modular furniture assembly according to claim 2, wherein the top panel is connected to a top portion of the tube and the bottom panel is connected to a bottom portion of the tube.

4. The modular furniture assembly according to claim 3, wherein at least one of said plurality of wall panels includes a door pivotally mounted at one end.

5. The modular furniture assembly according to claim 1, further comprising a door pivotally mounted to said top and bottom panels.

6. The modular furniture assembly according to claim 1, wherein the plurality of wall panels further comprises two opposed side walls and a back wall constructed therebetween.

7. The modular furniture assembly according to claim 6, further comprising a door pivotally mounted to said top and bottom panels.

8. The modular furniture assembly according to claim 6, further comprising a frame-shaped front wall connected between said opposed side walls opposite the back wall.

9. The modular furniture assembly according to claim 8, further including a door pivotally connected to the front wall.

10. The modular furniture assembly according to claim 1, wherein the plurality of wall panels further comprises a first side panel, a back panel having a first end connected to the first side panel and a second end connected to a second side panel, and wherein the modular furniture assembly further comprises a door pivotally mounted to said top and bottom panels opposite the back panel.

11. A method of assembling a modular furniture component, said method comprising the steps of:

providing a plurality of wall panels, each of said wall panels having a body portion and arcuate connector portions on either end thereof, said arcuate connector portions having an outer surface;

providing a plurality of cylindrical members having an outer perimeter;

providing a plurality of C-shaped sleeves having an inner surface;

providing a top panel;

providing a bottom-panel;

connecting said cylindrical members to the bottom panel at a bottom end thereof;

placing said wall panels adjacent said cylindrical members such that arcuate connector portions are disposed about said outer perimeter of said cylindrical members at a plurality of corners;

placing one of said sleeves adjacent each of said comers such that the inner surface of the sleeve is disposed about the outer surface of said arcuate connector portions; and connecting the top panel to said cylindrical members at a top end thereof.

12. The method as recited in claim 11, further comprising the step of pivotally connecting a door to the top panel and the bottom panel.

13. The method as recited in claim 11, further comprising the step of pivotally connecting a door to one of said wall panels.

14. The method as recited in claim 11, wherein the step of providing the plurality of wall panels comprises providing three wall panels, such that a back panel is attached between two side panels.

15. The method as recited in claim 14, further comprising the step of pivotally connecting a door to said top and bottom panels opposite the back panel.

16. The method as recited in claim 14, further comprising the step of providing a frame-shaped front panel which is connected to said side panels opposite the back panel.

17. The method as recited in claim 16, further comprising the step of pivotally attaching a door to said front panel.

18. The method as recited in claim 11, wherein the step of providing the plurality of wall panels comprises forming said wall panels by an injection molding process such that the body portion of said wall panels has screw bosses on a surface thereof.

* * * * *